US006116052A

United States Patent [19]

Ha et al.

[11] Patent Number: 6,116,052

[45] Date of Patent: Sep. 12, 2000

[54] CRYOGENIC AIR SEPARATION PROCESS AND INSTALLATION

[75] Inventors: Bao Ha, San Roman, Calif.; Jean-Renaud Brugerolle, Paris, France

[73] Assignees: Air Liquide Process and Construction, Houston, Tex.; L'Air Liquide, Societe Anonyme pour l'Etude et l'Exploitation des Procedes Georges Claude, Paris Cedex, France

[21] Appl. No.: 09/289,287

[22] Filed: Apr. 9, 1999

[51] Int. Cl.[7] ..... F25B 3/00

[52] U.S. Cl. ..... 62/646; 62/654

[58] Field of Search ..... 62/646, 654

[56] References Cited

U.S. PATENT DOCUMENTS

| | | | |
|---|---|---|---|
| 2,699,046 | 1/1955 | Etienne . | |
| 4,224,045 | 9/1980 | Olszewski et al. . | |
| 4,947,649 | 8/1990 | Agrawal et al. . | |
| 5,081,845 | 1/1992 | Allam et al. . | |
| 5,209,070 | 5/1993 | Darredeau | 62/646 |
| 5,228,296 | 7/1993 | Howard | 62/646 |
| 5,231,837 | 8/1993 | Ha . | |
| 5,257,504 | 11/1993 | Agrawal . | |
| 5,341,646 | 8/1994 | Agrawal et al. . | |
| 5,438,835 | 8/1995 | Rathbone . | |
| 5,582,033 | 12/1996 | Bonaquist et al. | 62/646 |
| 5,635,541 | 6/1997 | Smith et al. . | |
| 5,666,823 | 9/1997 | Smith et al. . | |
| 5,675,977 | 10/1997 | Prosser . | |
| 5,678,426 | 10/1997 | Agrawal et al. . | |
| 5,682,764 | 11/1997 | Agrawal et al. . | |
| 5,692,395 | 12/1997 | Agrawal et al. . | |
| 5,873,264 | 2/1999 | Bonaquist et al. | 62/643 |
| 5,881,570 | 3/1999 | Drnevich et al. | 62/646 |
| 5,887,447 | 3/1999 | Higginbotham | 62/643 |

FOREIGN PATENT DOCUMENTS

| | | |
|---|---|---|
| 0636845B1 | 4/1994 | European Pat. Off. . |
| 0684438B1 | 5/1995 | European Pat. Off. . |

*Primary Examiner*—Ronald Capossela
*Attorney, Agent, or Firm*—Linda K. Russell

[57] ABSTRACT

The present invention relates to processes and installations for the production of oxygen and nitrogen by cryogenic distillation. The cost of oxygen and nitrogen production is reduced by providing an improved high pressure process.

27 Claims, 7 Drawing Sheets

CRYOGENIC AIR SEPARATION PROCESS AND INSTALLATION

FIELD OF THE INVENTION

This invention relates to the processes and installations for the production of oxygen and nitrogen by cryogenic distillation.

BACKGROUND OF THE INVENTION

Over the years, numerous efforts have been devoted to the improvement of techniques for the production of oxygen and nitrogen by cryogenic distillation to lower production costs, which consist mainly of power consumption and equipment costs. As a general rule, an efficient process usually requires an increase in equipment cost such that the overall gain is a result of a trade-off between power and capital costs. Therefore there is a constant need to come up with an efficient and low cost process to assure a significant reduction in the final product cost.

The invention described below utilizes the concept of high pressure distillation to reduce the equipment cost of cryogenic equipment. Also, by incorporating a power recovery scheme, the separation power for oxygen and nitrogen can be improved. The net result is a reduction of equipment cost and power cost leading to a reduction in the production cost of oxygen and nitrogen.

Traditionally, most air separation units are designed for relatively low air pressure (about 5–6 bar absolute) in order to minimize the power consumption of the air compressor which is the significant portion of the overall power consumption. Oxygen or nitrogen products can be compressed to higher pressure to suit. Product compressors or an internal compression process with liquid pumped feature can be used. This low pressure process results in several penalties for equipment cost namely: large piping and equipment size (exchangers, columns) due to pressure drop constraints at low pressure, and large and complicated (high number of stages) product compressors due to the availability at low pressure of oxygen and nitrogen product. The reduction of power consumption therefore rapidly approaches an asymptotic value dictated by the prohibitive cost of the equipment. Not only does this low pressure process penalize the cryogenic equipment, it also has a negative impact on the warm end equipment as well. Indeed, cryogenic processes require the feed gases to be free of impurities, such as moisture and $CO_2$, which can freeze and plug the equipment at low temperature. Molecular sieve adsorption vessels with feed gas pre-cooling are used to remove these impurities. The lower the feed air pressure, the more difficult the adsorption process and the more adsorbent will be needed for the removal of impurities. Larger vessels and piping will also be needed to accommodate the low pressure drop. Overall, there is significant increase in equipment cost associated with the power cost reduction of the low pressure process.

Most of the negative effects caused by the low pressure can be eliminated if a high or elevated pressure process is used. A high pressure process is characterized by a high operating pressure in the low pressure column of a double-column process. By raising the pressure of the low pressure column from about 1.5 bar of the low pressure process to an elevated pressure as high as 2 to 7 bar, the feed air pressure needed for the high pressure column must be raised to as high as 20 bar. This high pressure results in very compact equipment for both warm end and cryogenic portions of the plant and significant cost reduction can be achieved. However, the high pressure process is detrimental and not favorable for a distillation operation, especially for the classical double column process. Indeed, when the low pressure column is operated above 3 bar absolute we can expect important loss of product recovery due to inefficient distillation and therefore high power consumption is unavoidable. Furthermore, the high pressure process will yield the nitrogen and oxygen products at elevated pressure and if only oxygen is needed as final product then the energy contained in the pressurized nitrogen must be recovered; otherwise inefficiency of the process will occur.

Several high pressure processes in cryogenics for air separation are described in the following patents.

U.S. Pat. No. 4,224,045 describes a high pressure plant where the feed air for an air separation unit is extracted from a gas turbine. The nitrogen product is recompressed for re-injection into the gas turbine loop for power recovery.

U.S. Pat. No. 4,947,649 describes a high pressure plant using a single column with nitrogen recycle heat pump to perform the air separation, instead of a double-column process. The feed air can be extracted from a gas turbine and the nitrogen product can be re-injected back into the gas turbine circuit.

U.S. Pat. No. 5,081,845 describes an integrated cryogenic air separation unit power cycle system wherein the air separation unit (ASU) is operated at elevated pressure to produce moderate pressure nitrogen. The integrated cycle combines a gasification section wherein a carbon source, e.g. coal, is converted to fuel and combusted in a combustion zone. The combustion gases are supplemented with nitrogen from the ASU and expanded in a turbine. Air to the cryogenic ASU is supplied via a compressor independent of the compressor used to supply air to the combustion zone used for combusting the fuel gas generated in the gasifier system.

U.S. Pat. No. 5,635,541 describes the possibility of using a high pressure process for oxygen production in remote areas where the power/fuel cost is low. A pressurized nitrogen product is expanded either across a valve or a power recovery turbine. This process emphasizes the cost reduction over the efficiency improvement.

U.S. Pat. No. 5,231,837 describes a triple-column process for high pressure application wherein a liquid rich in oxygen (rich liquid) of a high pressure column is further treated in an intermediate column to yield additional liquid reflux for a low pressure column. The intermediate column is reboiled by condensing nitrogen from the top of the high pressure column. A portion of the bottom liquid of the intermediate column is then vaporized in the overhead condenser of this column to yield a vapor feed to the low pressure column. By using this arrangement, the distillation process of the low pressure column is greatly improved, resulting in good oxygen recovery. If the air pressure or the low pressure column pressure are not too high, one can extract a significant amount of nitrogen product from the high pressure column to further improve the power consumption.

U.S. Pat. No. 2,699,046 describes processes wherein a rich liquid of a high pressure column is treated in a column or combination of columns reboiled by condensing the gases extracted from an intermediate level or from several levels of the high pressure column.

Several other high pressure or triple-column processes (often known as Etienne column processes) are also described in following patents published applications: U.S. Pat. Nos. 5,257,504, 5,438,835, 5,341,646, EP 636845A1, EP 684438A1, U.S. Pat. Nos. 5,513,497, 5,692,395, 5,682,764, 5,678,426, 5,666,823, and 5,675,977.

SUMMARY OF THE INVENTION

According to the invention there is provided a cryogenic air separation process comprising the steps of:

(a) feeding cooled air, substantially free of impurities, to a high pressure column to yield a first nitrogen-enriched gas at the top of the high pressure column and a first oxygen-enriched liquid at the bottom of the high pressure column;

(b) at least partially condensing the first nitrogen-enriched gas to yield a first nitrogen-enriched liquid stream, returning at least a portion of the first nitrogen-enriched liquid stream to the high pressure column as reflux and recovering a portion of the nitrogen-enriched gas as nitrogen product;

(c) feeding at least a portion of the first nitrogen-enriched liquid stream to an intermediate pressure column wherein a second nitrogen-enriched liquid is produced at the top of the intermediate pressure column and a second oxygen-enriched liquid at the bottom of the intermediate pressure column and feeding at least a portion of the second nitrogen-enriched liquid to a low pressure column;

(d) producing a third oxygen-enriched liquid in the low pressure column; and (e) vaporizing at least a portion of the third oxygen-enriched liquid in an overhead condenser of the intermediate pressure column or of the low pressure column.

According to a further aspect of the invention, there is provided an installation for the production of oxygen and nitrogen by cryogenic distillation including:

a high pressure column, an intermediate pressure column having a bottom reboiler and a top condenser and a low pressure column having a bottom reboiler;

means for sending cooled compressed air to the high pressure column;

means for sending a first nitrogen-enriched gas from the top of the high pressure column to the low pressure column bottom reboiler and sending a first nitrogen-enriched liquid from the bottom reboiler to the top of the high pressure column;

means for withdrawing nitrogen product gas from the high pressure column;

means for sending a first oxygen-enriched liquid from the high pressure column to the intermediate pressure column;

means for sending a second nitrogen-enriched liquid and a second oxygen-enriched liquid from the intermediate pressure column to the low pressure column;

means for sending oxygen-rich liquid from the bottom of the low pressure column to one of the top condenser of the intermediate pressure column and a top condenser of the low pressure column; and means for withdrawing a product oxygen stream from the top condenser.

BRIEF DESCRIPTION OF THE DRAWINGS

The invention will now be described in more detail with reference to the following figures.

DETAILED DESCRIPTION OF THE INVENTION

Figure 1:
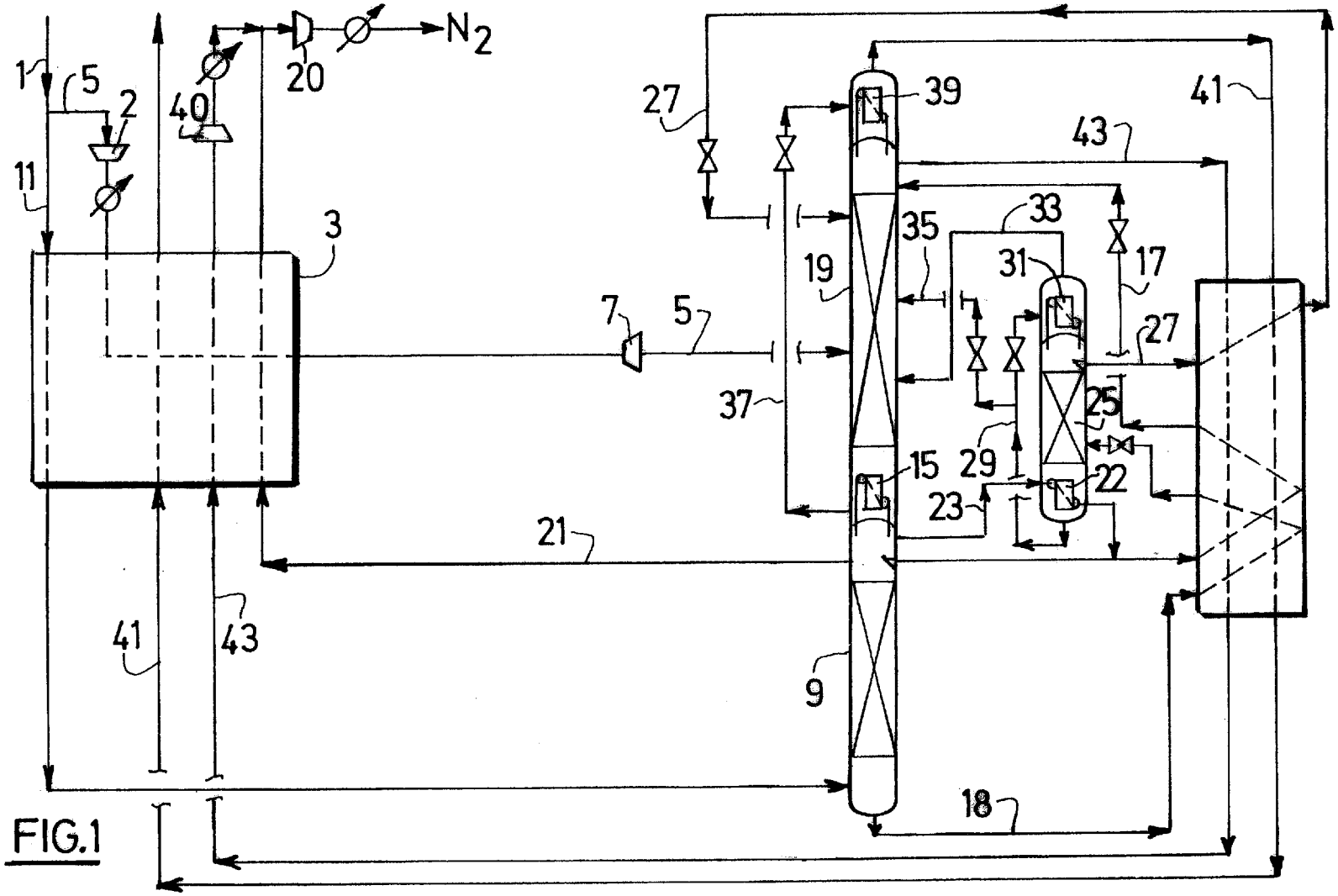
FIGS. 1 to 4 show process flow diagrams for processes according to the invention.

The present invention addresses the cost reduction of the oxygen and nitrogen products of a cryogenic air separation process by providing an improved high pressure process wherein economical equipment size and process efficiency can be achieved at the same time. This process can be integrated with a power recovery scheme to further improve the power consumption of the overall plant in situations where not all nitrogen product is recovered.

According to one embodiment, at least a portion of the third oxygen-enriched liquid is vaporized in the overhead condenser of the low pressure column and the second oxygen-enriched liquid or, alternatively, an intermediate liquid of the low pressure column is vaporized in the overhead condenser of the intermediate pressure column.

Preferably, the third oxygen-enriched liquid is withdrawn from a sump of the low pressure column.

Alternatively, the third oxygen-enriched liquid is withdrawn at least one theoretical tray above the sump of the low pressure column and an oxygen-rich fluid is withdrawn from the sump of the low pressure column.

To provide reflux, a third nitrogen-enriched liquid is withdrawn from the top of the low pressure column, pressurized and sent to the top of the high pressure column or at least a portion of the second nitrogen-enriched liquid is withdrawn, pressurized and sent to the top of the high pressure column.

Preferably, at least a portion of the first nitrogen-enriched gas is sent to a bottom reboiler of the intermediate pressure column, at least partially condensed and sent to at least one of the high pressure and low pressure columns.

In an alternative embodiment, the third oxygen-enriched liquid is sent to the overhead condenser of the intermediate pressure column, vaporized and withdrawn as a product gas.

In this case, the second oxygen-enriched liquid is sent to the low pressure column.

Part of the first nitrogen-enriched liquid may be sent to the low pressure column.

Preferably, the first nitrogen-enriched liquid is introduced into the low pressure column at least one theoretical tray below a point at which the second nitrogen-enriched liquid is introduced into the low pressure column.

To produce refrigeration, at least a portion of the air is expanded in a Claude turbine and sent to the high pressure column or part of the air is expanded and sent to the low pressure column.

Any other alternative means of production of refrigeration may be used such as liquid turbines, liquid assist, nitrogen expansion, etc.

In some cases, there is at least one theoretical tray below a point at which the first oxygen-enriched liquid is sent to the intermediate pressure column and/or at least one theoretical tray above a point at which the first oxygen-enriched liquid is sent to the intermediate pressure column.

In a particular embodiment, at least a portion of the feed air is compressed in a compressor which also supplies air to the combustion chamber of a gas turbine.

In some circumstances, all of the feed air is compressed in a compressor which also supplies air to the combustion chamber of a gas turbine.

A nitrogen-enriched gas from at least one of the columns may be sent to a combustion chamber.

The high pressure column operates in a range of from about 8 to about 30 bar and the low pressure column operates in a range of from about 2 to about 12 bar.

Preferably, there is a top condenser at the top of the low pressure column and means for sending one of an intermediate liquid of the low pressure column and a bottoms liquid of the intermediate pressure column to the condenser of the low pressure column.

Reflux may be supplied by means for sending a top liquid of one of the low pressure column and the intermediate pressure column to the top of the high pressure column.

In an alternative embodiment, there are means for withdrawing a liquid oxygen-rich stream at least one theoretical tray above the sump of the low pressure column and sending it to the top condenser of one of the intermediate column and the low pressure column.

In this case, there may be means for withdrawing a liquid oxygen stream from the sump of the low pressure column.

The installation may further include at least one turbine, means for sending feed air to the turbine and means for sending air from the turbine to one of the columns of the installation.

A first embodiment of the invention is illustrated in FIG. 1.

1000 $Nm^3/h$ of compressed air 1 at about 18.3 bar, substantially free of impurities subject to freezing at cryogenic temperatures, is cooled and divided into two streams. Stream 5 (30 $Nm^3/h$) is compressed in compressor 2, cooled to an intermediate temperature of heat exchanger 3, removed from the heat exchanger and expanded in a turbine 7 before being sent to a low pressure column 19.

Stream 11 (970 $Nm^3/h$) is fully cooled in the heat exchanger 3 before being sent to high pressure column 9. The high pressure column is operated at 18 bar but may be operated at pressures greater than about 8 bar and as high as about 30 bar.

In this column air is distilled to yield a first gaseous nitrogen-enriched stream at the top of the column and a second oxygen-enriched liquid at the bottom of the column. The first gaseous nitrogen-enriched stream condenses either totally or partially in the top condenser 15 to provide a nitrogen-enriched liquid stream. A first portion of this nitrogen-enriched liquid stream returns to the top of the high pressure column as reflux. A second portion 17 of the nitrogen-enriched liquid stream is fed to a low pressure column 19. This low pressure column is thermally linked with the high pressure column via the top condenser 15: Heat is transferred across this condenser to the bottom of the low pressure column providing the needed reboil.

The low pressure column 19 operates at about 6.5 bar but can operate at pressures ranging from about 2 bar to about 12 bar.

A gaseous nitrogen-rich stream 21 is recovered from the top of the high pressure column as a high pressure nitrogen product, following an optional compression step in compressor 20.

All the first oxygen-enriched liquid 18 is fed to an intermediate point of an intermediate pressure column 25 operated at an intermediate pressure between the high pressure and low pressure column pressures, here about 12 bar. The intermediate column 25 is reboiled by condensing at least a part 23 of the first nitrogen-enriched gas from the top of the high pressure column in bottom condenser 22. The intermediate column 25 further distills the oxygen-enriched liquid into two liquid streams: a second nitrogen-enriched liquid at the top of the column and a second oxygen-enriched liquid at the bottom of the column. The top liquid 27 is fed to the top of the low pressure column 19 at a point below the injection point of stream 17. A first portion 29 of the bottom liquid is vaporized in the overhead condenser 31 of the intermediate column to yield a vapor oxygen-rich stream 33 which is also fed to the low pressure column. A second portion 35 of the bottom liquid is fed to the low pressure column at a point above the injection point of stream 33.

Air stream 5 is injected between the entry points of streams 33, 35.

The low pressure column distills the multiple feeds 5, 17, 27, 33, 35 into a liquid oxygen stream at the bottom of the low pressure column and a low pressure gaseous nitrogen at the top of the low pressure column. At least a portion 37 of the liquid oxygen stream is vaporized in a condenser 39 located on top of the low pressure column to yield a gaseous oxygen product stream 41 at about 1.7 bar. The low pressure gaseous nitrogen condenses in the condenser of the low pressure column to yield a liquid nitrogen reflux for this column. A low pressure gaseous nitrogen stream 43 is extracted at the top of the low pressure column as a low pressure nitrogen product. It may be compressed at ambient temperature in compressor 40 to the pressure of stream 21 and then further compressed with stream 21 in compressor 20.

By vaporizing liquid oxygen in the condenser 39 of the low pressure column 19 and therefore providing a source of liquid reflux from this condenser for the low pressure column, it is possible to extract an important amount of high pressure gaseous nitrogen (290 $Nm^3/h$ at 17.8 bar) from the high pressure column as product without adversely impacting the oxygen product extraction rate.

It is possible to change the arrangement of the top condenser 31 of the intermediate column 25. For example, instead of vaporizing bottom liquid of the intermediate column in the condenser as in FIG. 1, one can opt to place the condenser inside the low pressure column or send liquid from the low pressure column 19 to this condenser to be vaporized, the resulting vapor being returned back to the low pressure column. The bottom liquid of the intermediate column can then be fed directly to the low pressure column without being vaporized.

Figure 2:
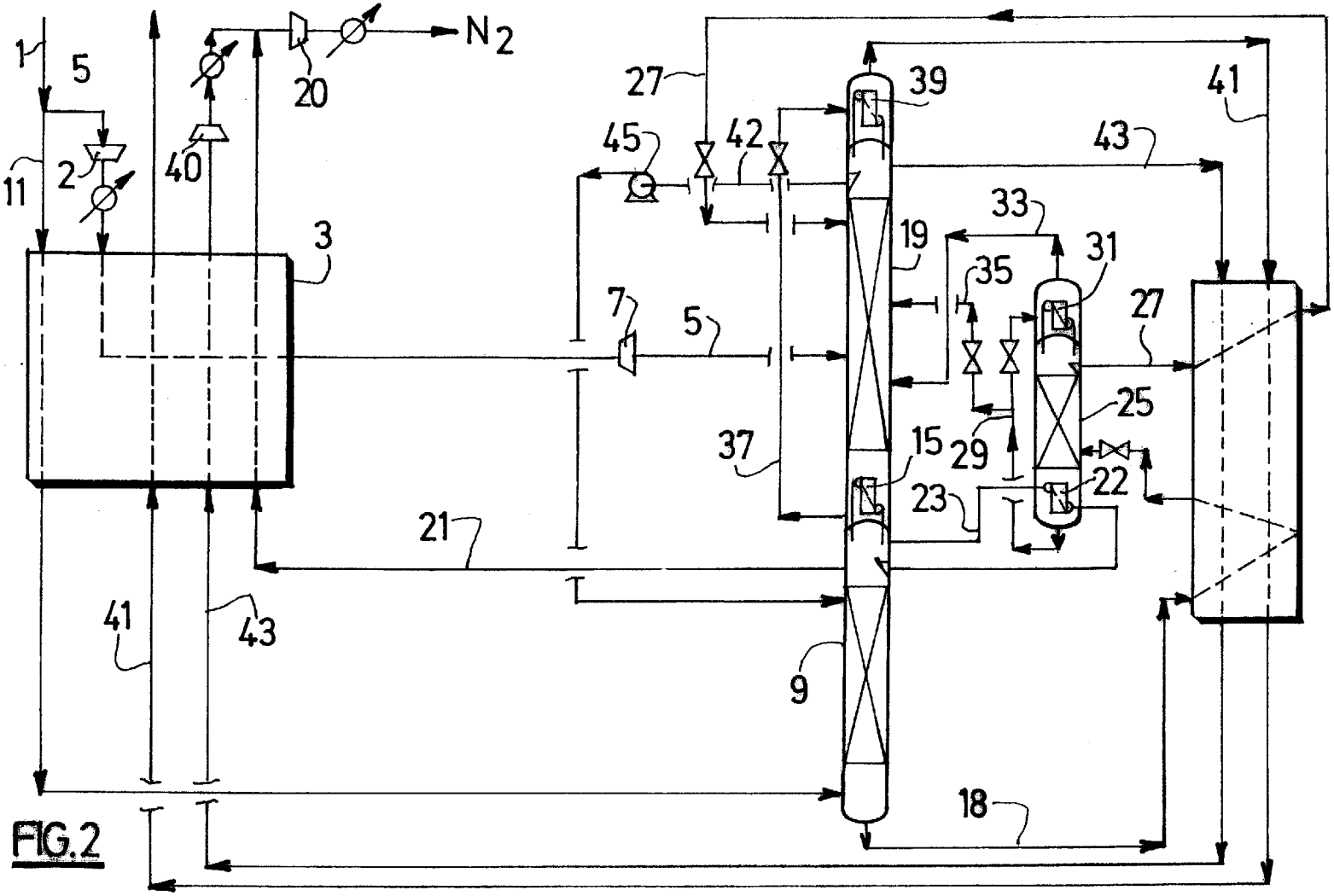

In a second embodiment depicted in FIG. 2, a portion of the liquid reflux 41 at the top of the low pressure column 19 is pumped (45) to higher pressure and fed to the top of the high pressure column 9. This feature further improves the reflux ratio at the top of the high pressure column allowing higher extraction rate of high pressure nitrogen product from this column. In this embodiment, the flow of a second portion of liquid nitrogen from the top of the high pressure column to the top of the low pressure column can be reduced to zero. It is also possible to pump the top liquid 27 of the intermediate column to the high pressure column instead to achieve similar results.

Figure 3:
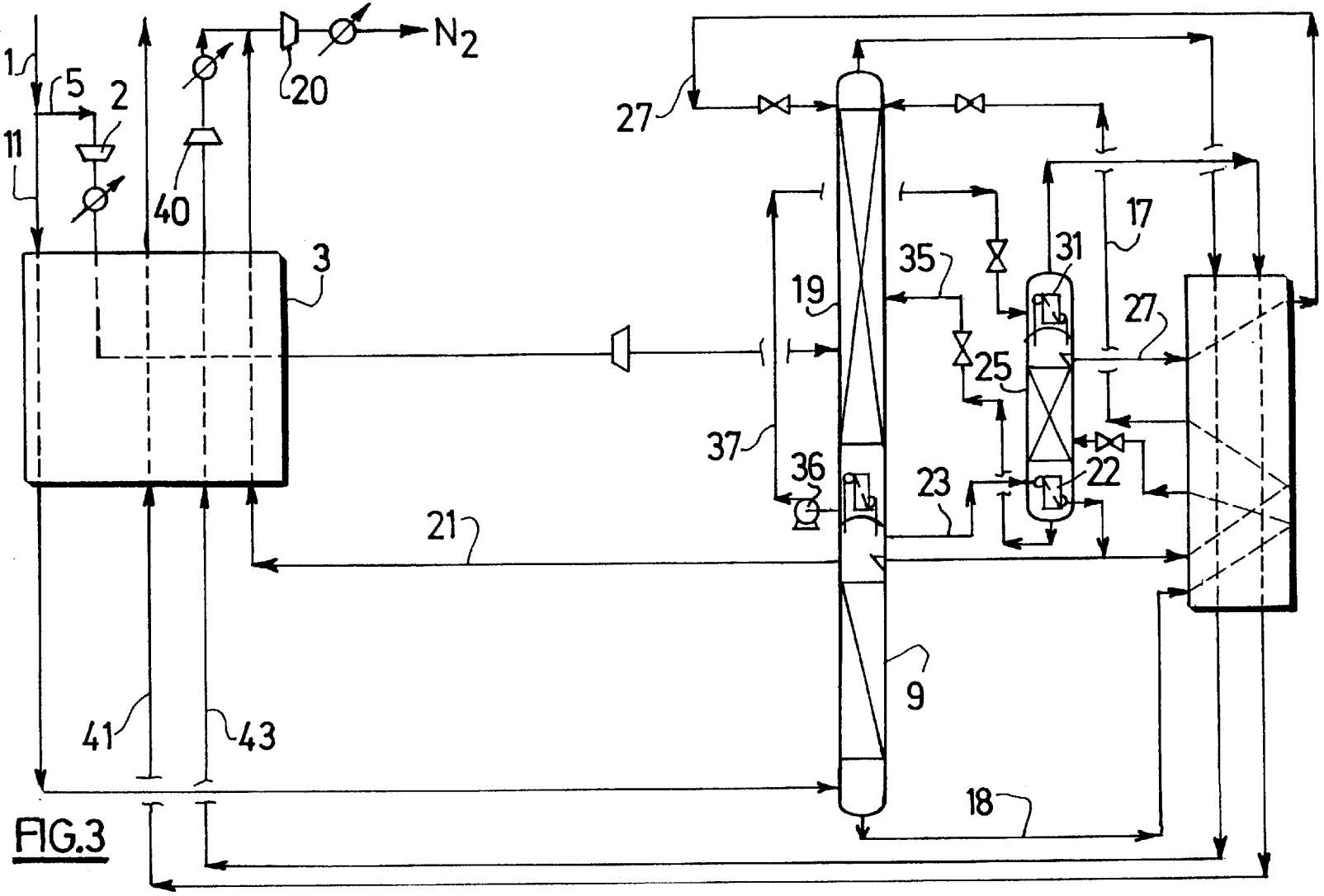

In a third embodiment illustrated in FIG. 3, the process of the first embodiment is modified: liquid oxygen from the bottom of the low pressure column is vaporized in a condenser 31 located on top of the intermediate column 25 instead of the low pressure column. In this case, the bottom liquid of the intermediate column can be fed to the low pressure column without being vaporized. The top condenser of the low pressure column is no longer present.

Typical pressures in this case would include about 10.5 bar for the feed air, about 6.5 bar for the intermediate pressure column and about 3.6 bar for the low pressure column, the impure oxygen being produced at about 1.7 bar.

Figure 4:
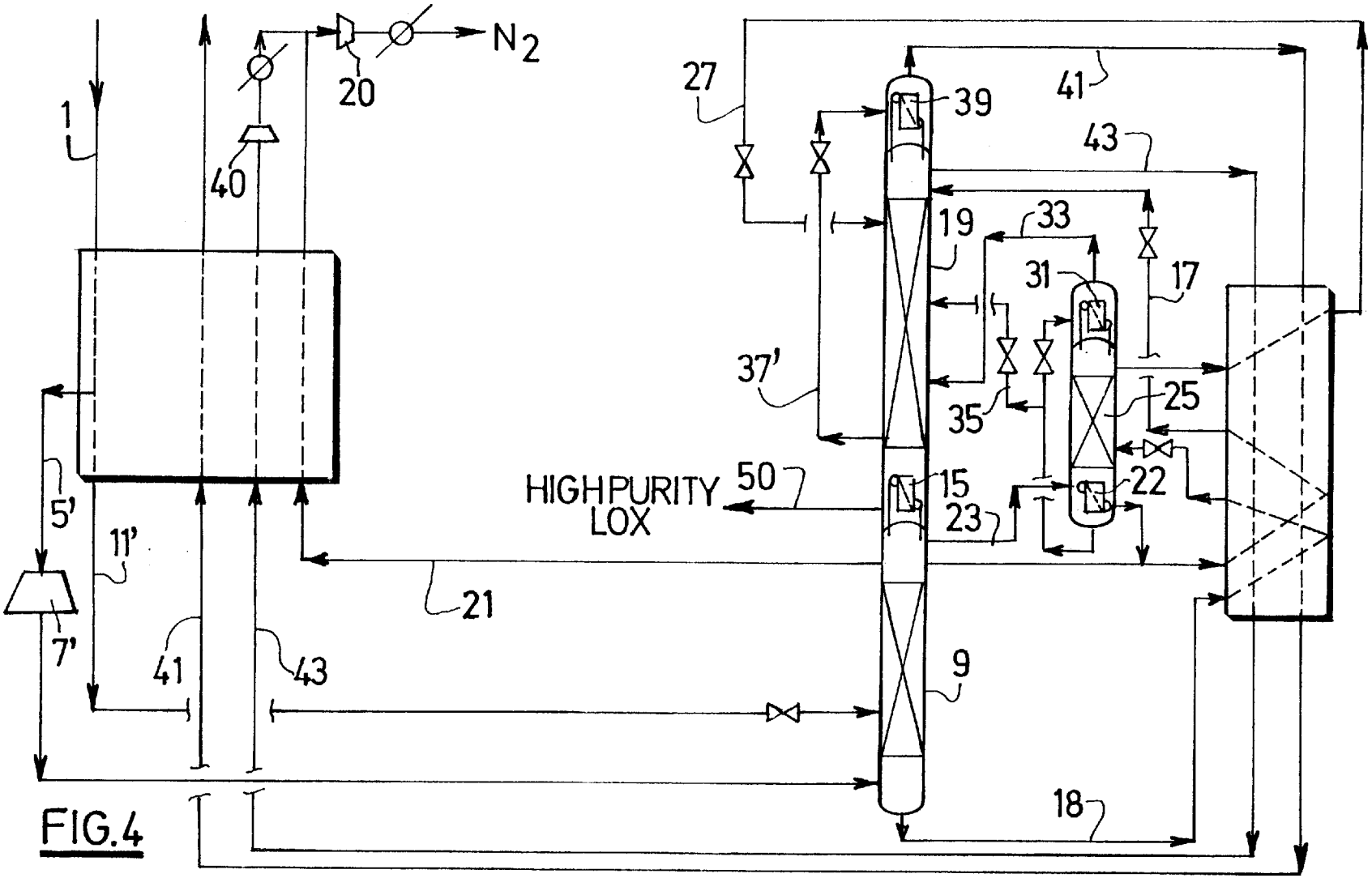

In a fourth embodiment shown in FIG. 4, the liquid oxygen instead of being produced at the bottom of the low pressure column is produced at a stage above the bottom stage of this low pressure column. This liquid oxygen 37' at low purity is sent to the top condenser of the low pressure column where it is vaporized to yield a lower purity oxygen product. Another liquid oxygen stream at higher oxygen purity 50 is extracted at the bottom of the low pressure column as high purity oxygen product. This feature allows an economical production of a minor portion of oxygen as high purity oxygen product (mixed production of high and low purity oxygen). The liquid oxygen 50 may be pressurized and vaporized in the heat exchanger 3.

In this embodiment, the refrigeration is supplied by expanding air stream 5' in Claude turbine 7' after partial cooling in heat exchanger 3. The remaining air 11' is condensed in exchanger 3, expanded in a valve and introduced into high pressure column 9 at a point above the introduction point of stream 5'.

Figure 5:
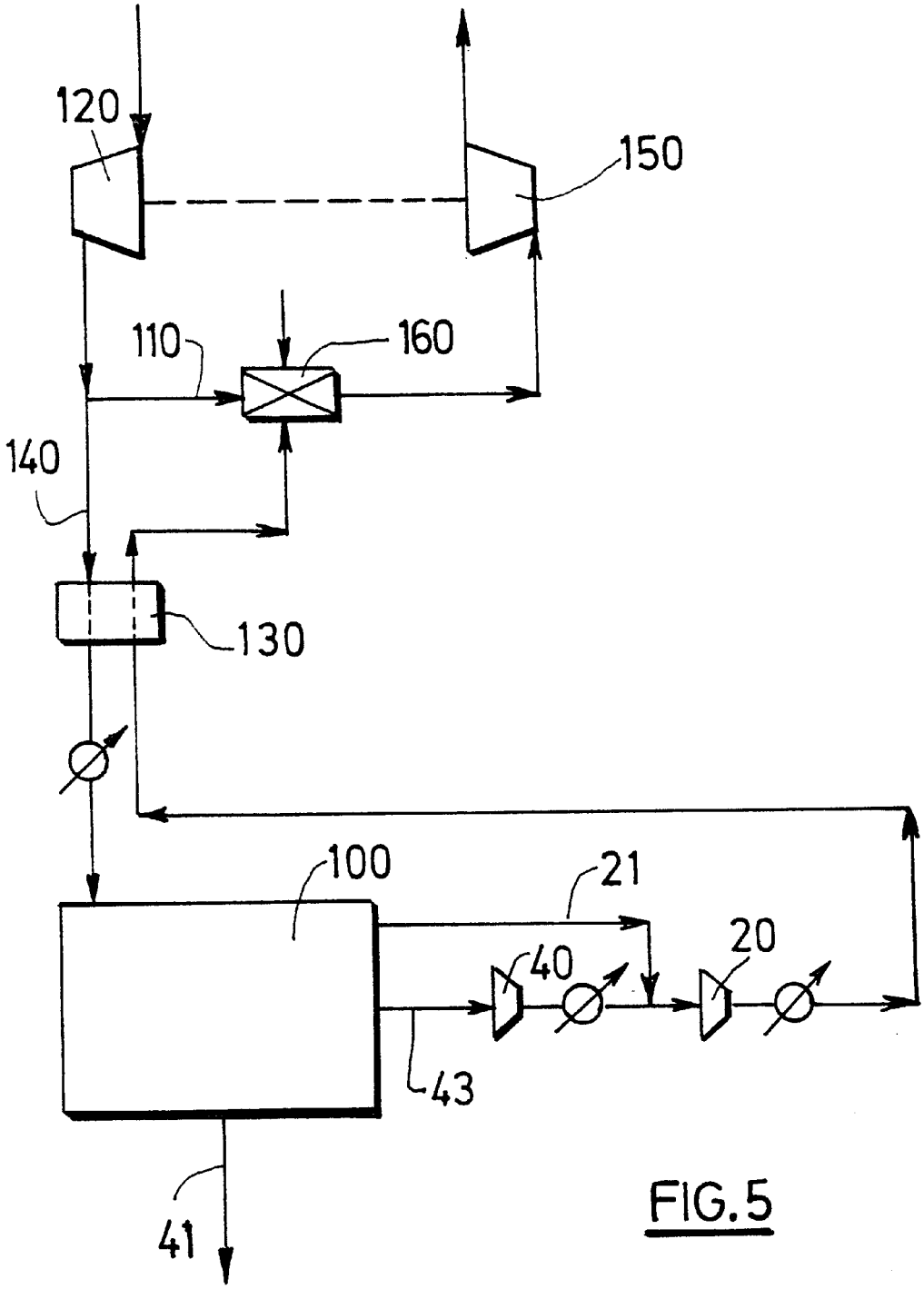
FIGS. 5 to 7 show the integration of air separation installations according to the invention with a gas turbine system.

In a fifth embodiment shown in FIG. 5, the feed air 140 for the air separation unit 100 (which may operate according to any of the processes shown in FIGS. 1 to 4) is extracted from the compressor 120 of a gas-turbine system. The nitrogen products (high pressure and low pressure) 21, 43 are compressed in a multi-stage compressor 40, 20 to essentially the same pressure as the feed air pressure. The nitrogen stream is re-injected into the gas-turbine combustion chamber 160 following warming in heat exchanger 130 against feed air 140.

The combustion chamber is also fed by compressed air 110 and a fuel stream. The gas produced by the combustion is expanded in turbine 150. It is useful to note, in this embodiment, that it is possible to drive the air separation unit with the air extracted from a gas-turbine.

Figure 6:
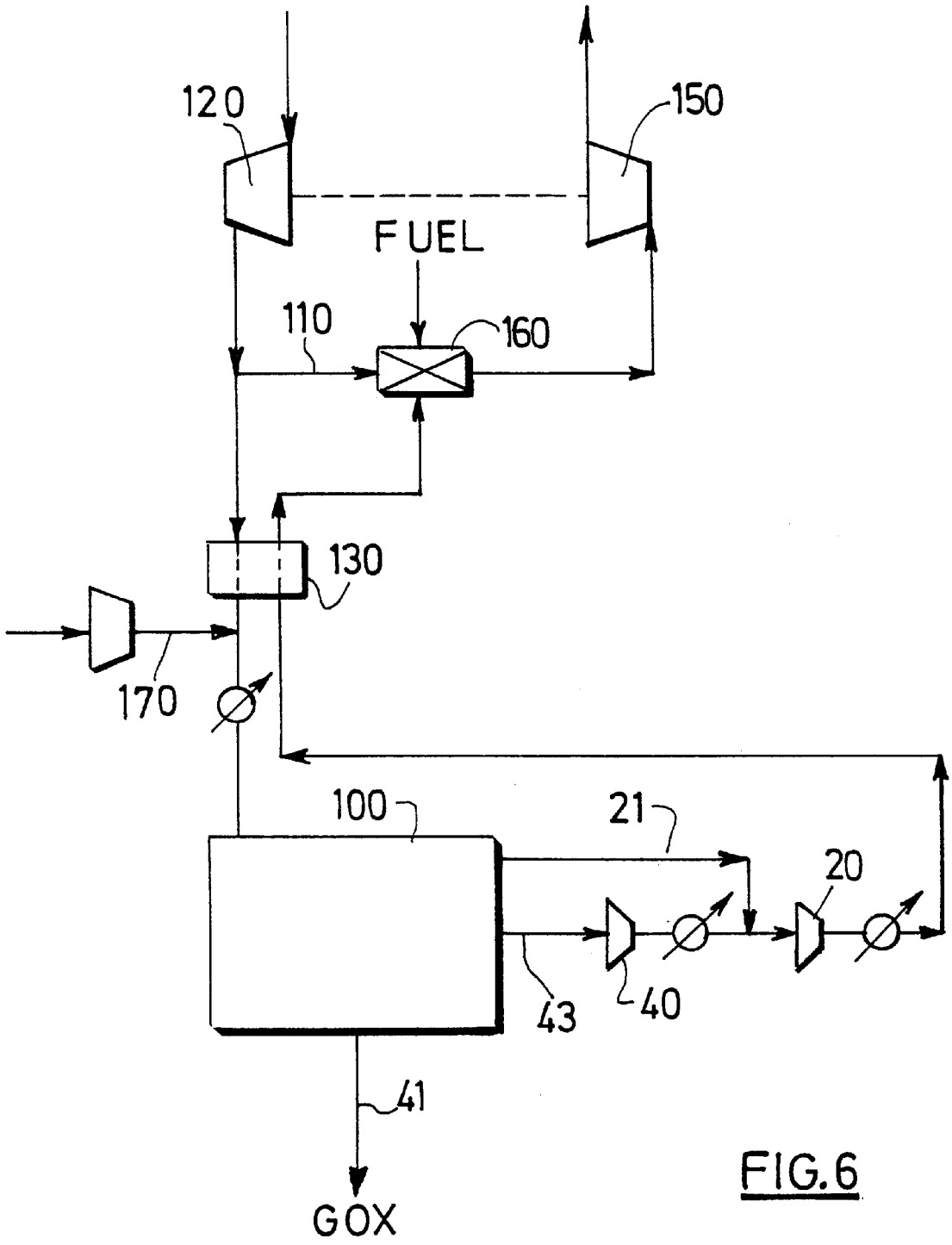

In a sixth embodiment illustrated in FIG. 6, the air feed of the fifth embodiment is combined with additional air 170 supplied by another compressor and the combined air is treated in the air separation unit for the production of oxygen and nitrogen.

Figure 7:
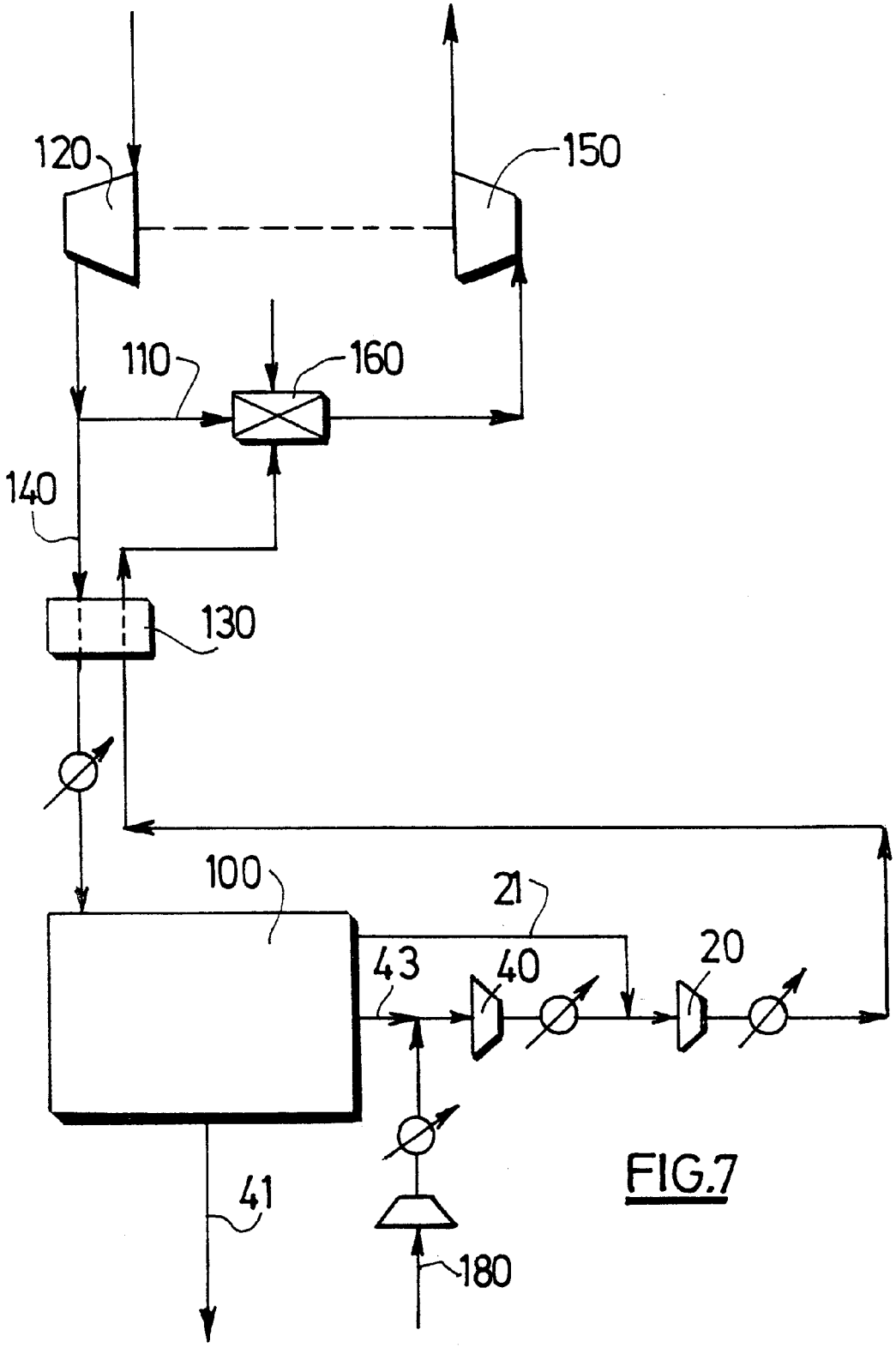

In a seventh embodiment depicted in FIG. 7, additional air 180 is fed to inlet of the nitrogen compressor 40 and the mixture is injected into the gas turbine loop.

Preferred processes for practicing the invention, as well as preferred installations for such processes, have been described. It will be understood that the foregoing is illustrative only and that other processes and installations can be employed without departing from the true scope of the invention defined in the following claims.

We claim:

1. A cryogenic air separation process comprising the steps of:

(a) feeding cooled air, substantially free of impurities, to a high pressure column to yield a first nitrogen-enriched gas at the top of the high pressure column and a first oxygen-enriched liquid at the bottom of the high pressure column;

(b) at least partially condensing the first nitrogen-enriched gas to yield a first nitrogen-enriched liquid stream, returning at least a portion of the first nitrogen-enriched liquid stream to the high pressure column as reflux and recovering a portion of the nitrogen-enriched gas as nitrogen product;

(c) feeding at least a portion of the first nitrogen-enriched liquid stream to an intermediate pressure column wherein a second nitrogen-enriched liquid is produced at the top of the intermediate pressure column and a second oxygen-enriched liquid at the bottom of the intermediate pressure column and feeding at least a portion of the second nitrogen-enriched liquid to a low pressure column;

(d) producing a third oxygen-enriched liquid in the low pressure column; and (e) vaporizing at least a portion of the third oxygen-enriched liquid in an overhead condenser of the intermediate pressure column or of the low pressure column.

2. The process of claim 1 wherein at least a portion of the third oxygen-enriched liquid is vaporized in the overhead condenser of the low pressure column and at least a portion of the second oxygen-enriched liquid is vaporized in the overhead condenser of the intermediate pressure column.

3. The process of claim 1 wherein at least a portion of the third oxygen-enriched liquid is vaporized in the overhead condenser of the low pressure column and an intermediate liquid of the low pressure column is vaporized in the overhead condenser of the intermediate pressure column.

4. The process of claim 2 wherein the third oxygen-enriched liquid is withdrawn from a sump of the low pressure column.

5. The process of claim 2 wherein the third oxygen-enriched liquid is withdrawn at least one theoretical tray above a sump of the low pressure column.

6. The process of claim 5 wherein an oxygen-rich fluid is withdrawn from the sump of the low pressure column.

7. The process of claim 2 wherein a third nitrogen-enriched liquid is withdrawn from the top of the low pressure column, pressurized and sent to the top of the high pressure column.

8. The process of claim 2 wherein at least a portion of the second nitrogen-enriched liquid is withdrawn, pressurized and sent to the top of the high pressure column.

9. The process of claim 1 wherein at least a portion of the first nitrogen-enriched gas is sent to a bottom reboiler of the intermediate pressure column, at least partially condensed and sent to at least one of the high pressure and low pressure columns.

10. The process of claim 1 wherein the third oxygen-enriched liquid is sent to the overhead condenser of the intermediate pressure column, vaporised and withdrawn as a product gas.

11. The process of claim 10 wherein the second oxygen-enriched liquid is sent to the low pressure column.

12. The process of claim 1 wherein at least a portion of the first nitrogen-enriched liquid is sent to the low pressure column.

13. The process of claim 12 wherein the first nitrogen-enriched liquid is introduced into the low pressure column at least one theoretical tray below a point at which the second nitrogen-enriched liquid is introduced into the low pressure column.

14. The process of claim 1 wherein part of the air is expanded in a Claude turbine and sent to the high pressure column.

15. The process of claim 1 wherein part of the air is expanded and sent to the low pressure column.

16. The process of claim 1 wherein there is at least one theoretical tray below a point at which the first oxygen-enriched liquid is sent to the intermediate pressure column.

17. The process of claim 1 wherein there is at least one theoretical tray above a point at which the first oxygen-enriched liquid is sent to the intermediate pressure column.

18. The process of claim 1 wherein at least a portion of the feed air is compressed in a compressor which also supplies air to a combustion chamber of a gas turbine.

19. The process of claim 1 wherein all of the feed air is compressed in a compressor which also supplies air to a combustion chamber of a gas turbine.

20. The process of claim 1 wherein a nitrogen-enriched gas from at least one of the columns is sent to a combustion chamber.

21. The process of claim 1 wherein the high pressure column operates in a range of from about 8 to about 20 bar and the low pressure column operates in a range of from about 2 to about 12 bar.

22. An installation for the production of oxygen and nitrogen by cryogenic distillation including:

a high pressure column, an intermediate pressure column having a bottom reboiler and a low pressure column having a bottom reboiler;

means for sending cooled compressed air to the high pressure column;

means for sending a first nitrogen-enriched gas from the top of the high pressure column to the low pressure column bottom reboiler and sending a first nitrogen-enriched liquid from the bottom reboiler to the top of the high pressure column;

means for withdrawing nitrogen product gas from the high pressure column;

means for sending a first oxygen-enriched liquid from the high pressure column to the intermediate pressure column;

means for sending a second nitrogen-enriched liquid and a second oxygen-enriched liquid from the intermediate pressure column to the low pressure column;

means for sending oxygen-rich liquid from the bottom of the low pressure column to one of a top condenser of the intermediate pressure column and a top condenser of the low pressure column; and means for withdrawing a product oxygen stream from the top condenser.

23. The installation of claim 22 comprising a top condenser at the top of the low pressure column and means for sending one of an intermediate liquid of the low pressure column and a bottoms liquid of the intermediate pressure column to the top condenser of the low pressure column.

24. The installation of claim 22 comprising means for sending a top liquid of one of the low pressure column and the intermediate pressure column to the top of the high pressure column.

25. The installation of claim 22 comprising means for withdrawing a liquid oxygen rich stream at least one theoretical tray above the sump of the low pressure column and sending it to the top condenser of one of the intermediate column and the low pressure column.

26. The installation of claim 25 comprising means for withdrawing a liquid oxygen stream from the sump of the low pressure column.

27. The installation of claim 22 comprising a turbine, means for sending feed air to the turbine and means for sending air from the turbine to one of the columns of the installation.

* * * * *